US010655405B1

(12) United States Patent
Loiselle et al.

(10) Patent No.: US 10,655,405 B1
(45) Date of Patent: May 19, 2020

(54) METHOD AND APPARATUS FOR OPTIMIZING A WELL DRILLING OPERATION

(71) Applicant: Sun Energy Services, LLC, Zelienople, PA (US)

(72) Inventors: Dustin Loiselle, Portersville, PA (US); Kevin James Hollerich, Bethel Park, PA (US); Matt Tourigny, Mars, PA (US)

(73) Assignee: Sun Energy Services, LLC, Zelienople, PA (US)

( * ) Notice: Subject to any disclaimer, the term of this patent is extended or adjusted under 35 U.S.C. 154(b) by 0 days.

(21) Appl. No.: 16/541,709

(22) Filed: Aug. 15, 2019

(51) Int. Cl.
*E21B 19/00* (2006.01)
*E21B 47/00* (2012.01)
*E21B 37/00* (2006.01)
*E21B 29/00* (2006.01)

(52) U.S. Cl.
CPC ..... *E21B 19/00* (2013.01); *E21B 37/00* (2013.01); *E21B 47/00* (2013.01); *E21B 29/00* (2013.01)

(58) Field of Classification Search
CPC ..... E21B 19/00; E21B 47/00; E21B 37/00; E21B 29/00
See application file for complete search history.

(56) References Cited

U.S. PATENT DOCUMENTS 6,467,557 B1 * 10/2002 Krueger ..... E21B 4/18 175/104
7,054,750 B2 5/2006 Rodney et al.
9,175,557 B2 * 11/2015 Iversen ..... E21B 44/00
2004/0016540 A1 * 1/2004 Jarchau ..... E21B 37/00 166/222
2005/0209912 A1 * 9/2005 Veeningen ..... G06Q 10/06 705/7.12
2005/0211468 A1 * 9/2005 Veeningen ..... E21B 7/04 175/24
2009/0090511 A1 * 4/2009 Zupanick ..... E21B 17/023 166/369
2009/0301723 A1 * 12/2009 Gray ..... E21B 23/00 166/301
2012/0181084 A1 * 7/2012 Pilgrim ..... E21B 19/00 175/57
2014/0124218 A1 * 5/2014 Pilgrim ..... E21B 44/02 166/380
2015/0034136 A1 * 2/2015 Bakke ..... B05B 1/083 134/167 C
2015/0107899 A1 * 4/2015 Fisher, Jr. ..... E21B 49/003 175/27

(Continued)

OTHER PUBLICATIONS

Cheatham, "The Evolution of Real-time Torque & Drag Analysis from Manual Local Usage to Automated Cloud-based Analytics", SPE GCS Annual Drilling Symposium, Mar. 15, 2018, 22 pages.

*Primary Examiner* — Mohammad K Islam
(74) *Attorney, Agent, or Firm* — The Webb Law Firm

(57) ABSTRACT

In a snubbing operation, a method is used for determining when a wellbore should be circulated by comparing calculated torque and drag values from a clean wellbore against actual torque and drag values. In a more expansive application, for working a well, a method is used for optimizing performance of the drilling operation by comparing calculated torque and drag values from a clean well against actual torque and drag values.

20 Claims, 7 Drawing Sheets

(56) References Cited

U.S. PATENT DOCUMENTS

| | | | | |
|---|---|---|---|---|
| 2016/0032697 | A1* | 2/2016 | Harris | E21B 43/12 166/373 |
| 2016/0053604 | A1* | 2/2016 | Abbassian | E21B 44/00 702/6 |
| 2016/0298415 | A1* | 10/2016 | Takahashi | E21B 33/1208 |
| 2017/0254148 | A1* | 9/2017 | Kannegaard | E02B 17/021 |
| 2017/0268324 | A1* | 9/2017 | Moore | E21B 44/00 |
| 2018/0016872 | A1* | 1/2018 | Randle | E21B 34/08 |
| 2018/0023382 | A1* | 1/2018 | Ringer | E21B 44/00 175/50 |
| 2018/0058187 | A1* | 3/2018 | Magnuson | E21B 19/20 |
| 2018/0087368 | A1* | 3/2018 | Mills | E21B 34/02 |
| 2019/0128079 | A1* | 5/2019 | Omrani | E21B 19/20 |
| 2019/0234177 | A1* | 8/2019 | Silva | E21B 33/1293 |
| 2019/0234208 | A1* | 8/2019 | Orban | E21B 4/02 |
| 2019/0257176 | A1* | 8/2019 | Dykstra | E21B 41/0092 |
| 2019/0271198 | A1* | 9/2019 | Stewart | E21B 19/168 |

* cited by examiner

METHOD AND APPARATUS FOR OPTIMIZING A WELL DRILLING OPERATION

BACKGROUND OF THE INVENTION

Field of the Invention

This invention relates to monitoring in real time the torque of a rotating tubular within a well and comparing this data against calculated values to optimize the drilling operation. In one embodiment, the invention relates to using this data to determine when to circulate a wellbore during the snubbing operation of a nonconventional well.

Description of Related Art

All operations to which the subject invention may apply involve a rotating tubular within the well and require monitoring the torque imparted to the rotating tubular. Although the subject invention may be applied to other drilling operations, such as cased hole, open hole, or horizontal drilling applications during construction operations, the operation will first be described with respect to a snubbing operation for a nonconventional well.

Snubbing is the act of moving tubular into and out of a wellbore of a nonconventional well when the blowout preventers (BOPs), which may be comprised of both annular BOPs and ram BOPS, are closed and pressure is contained in the well. If only the annular BOP is closed, the tubular may be slowly and carefully lowered into the wellbore and the annular BOP itself will open slightly to permit the larger diameter tubular joints to pass through. If the well has been closed with the use of ram BOPs, the tubular joint will not pass by the closed ram element. Hence, while keeping the well closed with either a second ram, BOP, or the annular BOP, a first ram must be opened manually, then the tubular is lowered until the tubular joint is just below the first ram, and then the first ram must be closed again. This procedure is repeated whenever a tubular joint must pass by a ram BOP.

In snubbing operations, the pressure in the wellbore acting on the cross-sectional area of the tubular exerts force on the end of the tubular within the well. As a result, the tubular may experience one of two conditions. For a well under pressure, when a tubular is first introduced into the well, the force caused by the pressure in the well acting against the tubular, if the tubular was unrestrained, would eject the tubular from the well. Therefore, the tubular must be restrained to prevent ejection. This is known as a "pipe light" condition. To advance the tubular within the well under these conditions, the tubular must be pushed (or "snubbed") back into the wellbore. At some point, as more tubular is inserted into the well, the weight of the tubular is sufficient to equal the force on the tubular of the well pressure. As more tubular is added, then the weight of the tubular is greater than the ejection force exerted on the tubular by the pressure in the well and the tubular must now be restrained from falling into the well under its own weight. This is known as a "pipe heavy" condition.

A snubbing unit changes operation from "pipe light" to "pipe heavy" as tubular is added to the well. It should be appreciated that, depending upon the stage of development of a well, the snubbing unit may encounter either of these conditions and in the "pipe light" condition must restrain the tubular from being ejected from the well while in the "pipe heavy" condition must support the tubular from falling into the well.

Directing attention to prior art FIGS. 1 and 2, typically snubbing occurs during a workover or hydraulic completion of a nonconventional well 10. In particular, at one stage during the development of a nonconventional well, perforations 12 are intentionally created within the casing 15 of the wellbore 17 to allow gases released through fractures 18 from the fracking processes to travel through the perforations 12 into the casing 15 and back up through the wellbore 17. However, prior to this, during the snubbing operation, segments 22 of the casing 15 are isolated to form chambers therebetween using frac plugs 25. Hydraulic completion of the well requires breaching of these frac plugs 25 to release the gas through the wellbore 17.

In order to achieve this goal, a drill head 30 is attached to the end of a tubular string 35 which enters the casing 15 and essentially drills out the frac plugs 25 thereby releasing the gas.

Once a frac plug is breached, then not only fragments of the frac plug but also the contents of the chamber that has been breached, including a slurry of sand, clay, and water introduced during the fracking process, are now released into the casing of the wellbore.

As more frac plugs are breached, more of the sand/clay/water slurry is released within the casing. This creates a significant additional drag resisting rotation of the tubular string. At some point, the work required to rotate the tubular string within the accumulated slurry significantly detracts from the ability to rotate the drill head to breach the frac plugs. At this time, this accumulation of slurry must be cleaned out from the casing by circulating the well.

Circulating is the process of circulating fluids through the well casing to clean the well. Circulating flushes residual material, such as the slurry previously discussed, through the well casing and back to the surface. During this time, rotation of the tubular string is temporarily suspended.

Overall, the expense associated with a snubbing operation is great and, therefore, efficiency is important. During the process of circulating, the tubular string is no longer rotating and fluids are forced through the tubular string to flush the slurry from the casing. This process itself is time consuming. However, the greatest detriment is the cost associated with the suspension of drilling that occurs while the circulating process takes place. Therefore, it is economically critical to circulate the well as little as possible while retaining optimum drilling performance.

In some instances, the operator would circulate after breaching a specified number of frac plugs, for example, four frac plugs. Other operators may initiate circulating when the operator felt the surface torque on the tubular string was too great.

However, the inventors have discovered a more precise way of determining when the well should be circulated and that such a method may also be used to optimize operation of the drilling process.

In particular, within a clean casing, which is a casing without the presence of the slurry, typically the only forces acting upon the drill head 30 and the tubular string 35 within the casing 15 are those frictional forces associated with the interaction between the combination of the tubular string 35 and the drill head 30 with the interior circumference of a clean casing 15.

Such a clean casing is suitable for mathematical modeling. In such modeling, the torque is calculated based upon the frictional forces between the rotating tubular and the internal wall of the well casing. The most common modeling technique provides data in the form of torque and drag (T&D) charts to give a drill operator guidelines for drilling.

Briefly stated, for a particular tubular string within a particular casing, the T&D charts provide the surface torque exerted upon the tubular string within the casing. Torque rotates the tubular string and drag is the result of friction caused by the pipe moving inside the casing.

A typical T&D chart is illustrated in FIG. 3, which is prior art. The angled line on the chart is calculated by inputting into the mathematical model the tripping speed which is the longitudinal speed of the tubular string traveling through the casing, the rotation speed which is the rotation speed of the tubular string within the casing, the kinetic friction of the tubular string within the casing, the mechanical properties of the tubular itself, the length of tubular string within the wellbore and the fluid weight against the tubulars in the wellbore. These factors are used to calculate the surface torque required to rotate the tubular string at a particular string depth.

While many variables in producing a T&D chart are known with a high level of certainty, there are some features of individual wells, such as mud type (oil-based or water-based) or pipe moving in the casing, that are difficult to calculate and, as a result, an adjustment variable identified as a friction factor is introduced into the equations to compensate for these unknowns.

As a general rule, the friction factor may be in the range of 0.2-0.3. The selection of a friction factor is generally job specific and the drilling operator, based upon experience and historical data, provides a friction factor to be used for the torque calculated for a particular well or family of similar wells. To be clear, actual friction is generated between the rotating tubular and the well casing and there is the additional friction factor used to account for the many influences not directly addressed in the equations but specific to an individual well or family of wells.

The actual process for determining a useable set of T&D charts may be iterative. Before the job starts, the baseline friction factor is selected based upon historical data from wells in the area and other nearby wells the operator has completed. Once the first well pad is drilled, then actual data from the pad being operated upon may be used to adjust the friction factor to model upcoming wells as operations continue. Therefore, this process essentially narrows the scope from a local area to the actual wells that are being worked on directed to completing a particular well pad.

The friction factor is applied to the mathematical model representing a clean well to adjust for those variables that are unique to each well but not included with individual variables in the model.

FIG. 3 is essentially a snapshot of the conditions the tubular string will experience in a particular well while rotating at a speed of 25 RPM and tripping at a speed of 30 ft/min for a string depth between 0 ft and approximately 20,000 ft.

Overall, the values from the T&D chart in FIG. 3 are calculated using equations and may be calculated using computer software such as the TADPRO® software package available from Pegasus Vertex, Inc. from Houston, Tex. It should be noted that there are other commercial software packages that provide similar analyses. These values represent the mathematical modeling of the clean well with the introduction of a friction factor.

The mathematical modeling of the equations for calculating such T&D charts and the surface torque for a particular tripping speed at a particular rotation speed for a particular string depth are well-known to those skilled in the art. The introduction of the friction factor in these equations is also well-known by those skilled in the art.

The line in FIG. 3 represents a friction factor of 0.25. However, depending upon the condition of the casing, tubulars, and the drill head, the friction factor can be adjusted.

As illustrated in FIG. 3, the tubular string requires no torque and, therefore, is not rotated as it is being dropped within the vertical well to a distance of, for example, a depth of about 10,000 ft, which is identified as the kickoff point. This portion of the graph is just a vertical line. Therefore, the tubular string changes orientation from a vertical travel to a horizontal travel through a lateral extending at a lower portion of the well. At this point the tubular string is rotated. Now the tubular string is contacting the bottom inner wall of the casing and friction inhibits both the tripping speed and rotation speed of the tubular. Because the tubular string is now rotating, the surface torque increases from 0 to 1,600 ft-lb.

Note that while the y-axis in FIG. 3 is directed to the string depth in feet, this actually is the length of tubular string extending vertically from the surface and then laterally through the casing. Therefore, essentially the string depth is the length of string within the well.

In the past, a chart similar to FIG. 3 would be utilized as a guideline for most of the drilling operation of a well. The desired rotation speed and tripping speed for a particular tubular string and casing was suggested, and the operator would then use these factors as a guideline to approximate the surface torque to be applied.

However, this chart was for a single rotation speed and tripping speed and was not used to determine optimum tubular rotation and tripping speed or to determine when the well should be circulated.

However, a typical drilling operation requires multiple rotation speeds and tripping speeds. By closely monitoring this data, the drilling operation may become more efficient.

As a result, one potential benefit of the subject invention by monitoring this data during the snubbing operation is to more accurately determine when a well must be circulated thereby allowing reduction in the number of circulating processes implemented during the hydraulic completion of a well. Additionally, it may also be possible to operate a drilling process with more efficiency. In addition, the subject invention may provide a real time data analysis while drilling which can be used not just to avoid exceeding torque thresholds for a particular tubular, but maximizing drill time before such thresholds are reached.

SUMMARY OF THE INVENTION

One embodiment of the subject invention is directed to completion of a non-conventional well, with perforated well casings in place within the wellbore and frac plugs separating segments of the well casing. A method of optimizing when to circulate the well comprises the steps of inserting a tubular string within the well casing and monitoring in real time the actual tripping speed, the actual string rotation speed, and the actual surface torque imparted to the tubular string at a particular string depth. For the given tubular string and for a predefined clean well casing based upon the actual well casing using a mathematical model of the predefined well casing with a friction factor, a calculated value of surface torque may be generated with at the particular string depth, the actual tripping speed, and at the actual rotation speed of the tubular string. Thereafter, the operator should compare the actual values of surface torque at the particular string depth to the calculated values of surface torque for the predefined well casing with a friction factor at the particular string depth. When the actual value of surface torque exceeds the calculated value of surface torque by a predetermined amount, then the well may be circulated to clean out the residual material.

In lieu of circulating the well, this information may be used to activate an alert or alarm to identify the operator of this condition.

Another embodiment of the invention is directed to a system for achieving this task.

Yet another embodiment of the invention is a method using this information for working a well to optimize a drilling operation.

DESCRIPTION OF THE INVENTION

Figure 1:
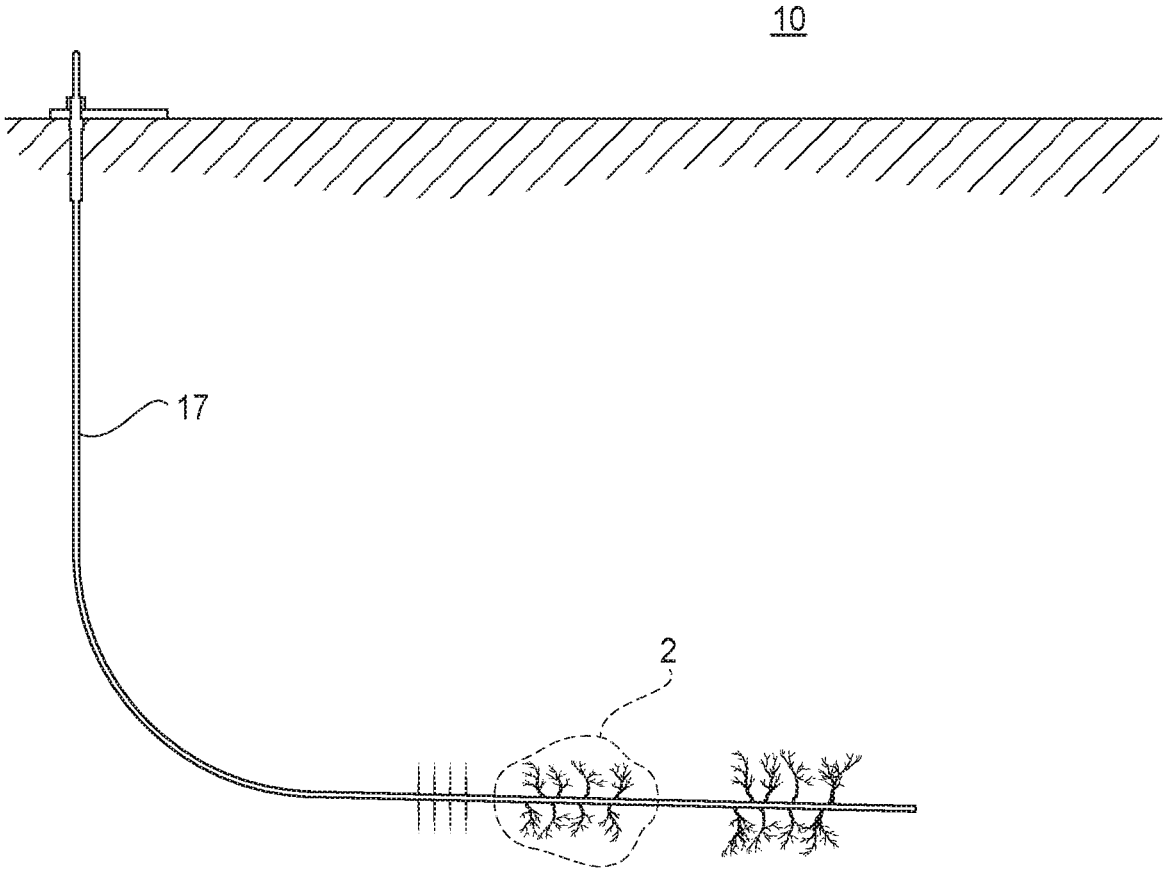
PRIOR ART FIG. 1
FIG. 1 is prior art and is a simplified sketch of a cross-section of a nonconventional well.
Figure 2:
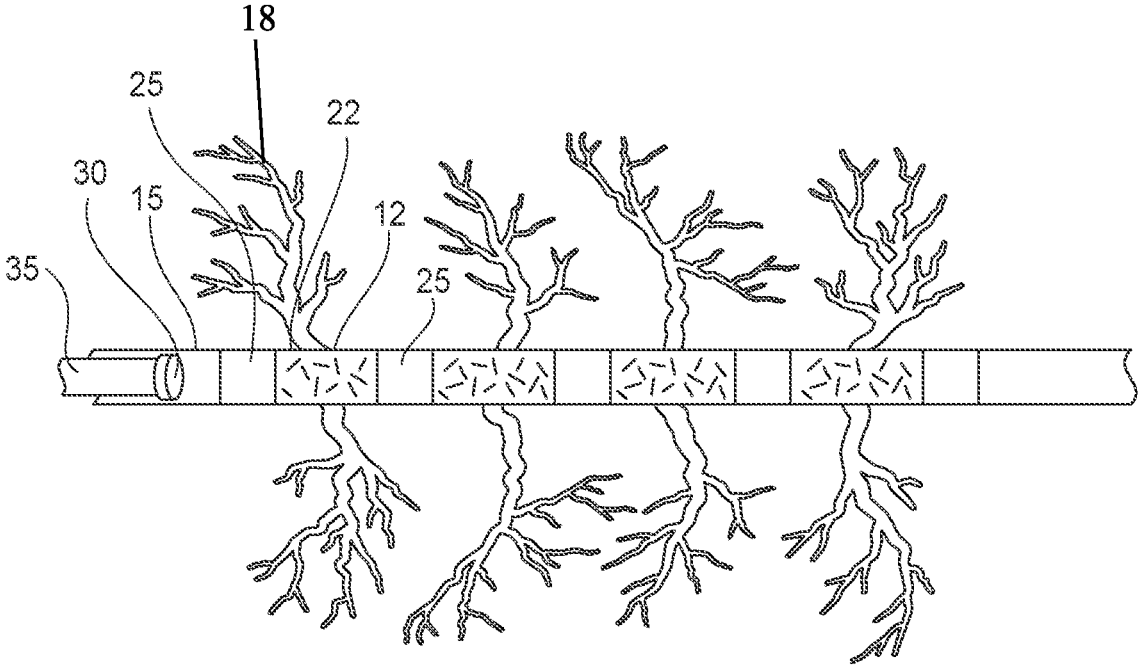
PRIOR ART FIG. 2
FIG. 2 is prior art and is an enlarged portion of FIG. 1 identified as item 2 in FIG. 1 illustrating the fracking region and the perforated casing segmented with frac plugs.
Figure 3:
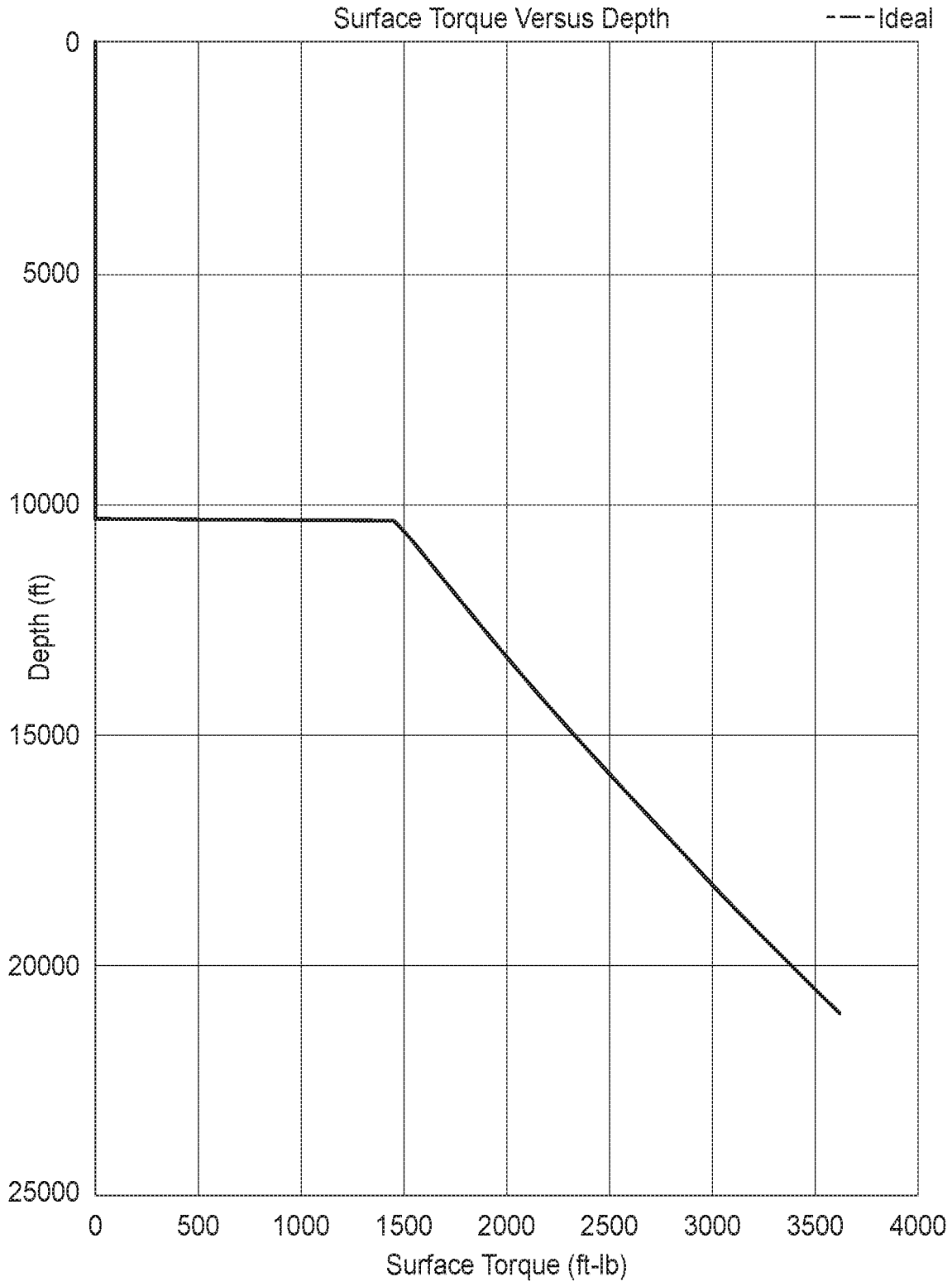
PRIOR ART FIG. 3
FIG. 3 is prior art and illustrates a T&D chart with a tripping speed of 30 ft/min and a rotation speed of 25 RPM for a tubular string with a 2⅞ inch OD.
Figure 4:
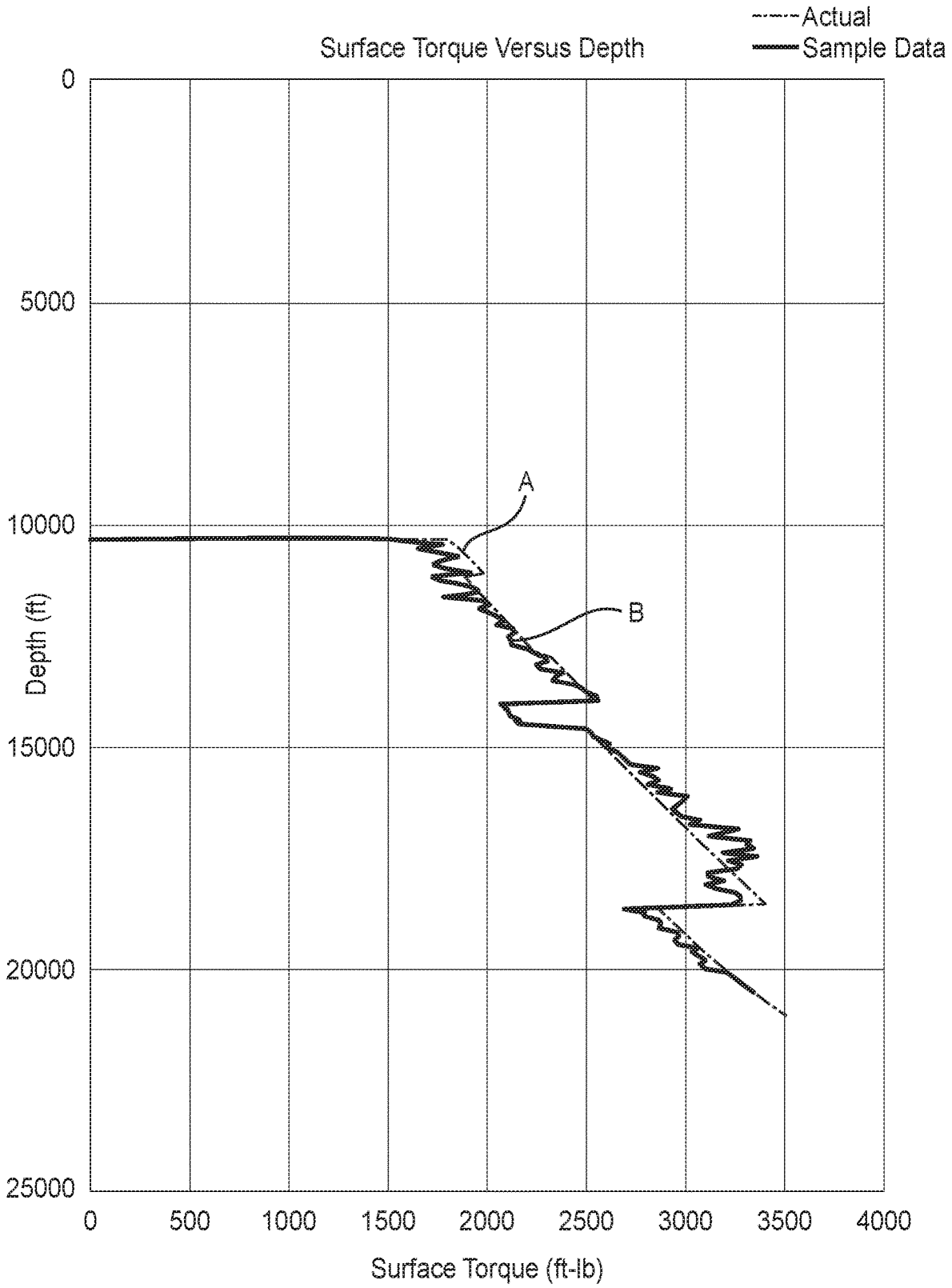
FIG. 4 illustrates a T&D chart with calculated values of surface torque at actual rotation speeds and trip speeds and with the real values of surface torque superimposed at those same conditions.

The inventors have realized that by using the T&D charts with values calculated at actual rotation speeds and tripping speeds, the operator has available much better information for efficient operations. FIG. 4 illustrates, through the use of mathematical modeling with a friction factor, a T&D chart showing the instantaneous calculated surface torque values at the actual rotation speed and tripping speed in a clean casing, represented by the line labelled "A". These values were calculated with a friction factor of 0.25. The chart also illustrates the instantaneous actual values using the same conditions for the clean casing at different depths represented by the line labeled "B".

With the belief that the circulating process occurs too frequently during hydraulic completion of nonconventional wells, the inventors sought a way to reduce these occurrences. The inventors realized that by acquiring real time values of the surface torque for a particular string depth, tripping speed, and rotation speed over a range of string depths, these could be compared against the calculated values calculated for a clean casing. Using the mathematical model, the surface torque value could be calculated at any rotation speed, tripping speed, and tubular string depth that the tubular string experiences. When the actual surface torque exceeds the calculated value of the surface torque, then it is likely the increased torque was the result of slurry in the well casing impeding advancement and rotation of the tubular, which as a result, would require circulating the well at some point.

The calculated value of torque along with other calculated values are based upon real time outputs from the sensors and inputting them into the modeling software, such as TadPro® software, to get a calculated value of the torque at the given depth.

Under mathematical modeling conditions where the casing is clean and using a preselected friction factor, surface torque versus string depth closely follows the relatively straight line "A" of the graph illustrated in FIG. 4. However, as mentioned, when a significant amount of slurry is released by, for example, breaching the frac plug, then the tubular string and the drill bit become surrounded by the slurry. As a result, with the accumulation of this slurry the surface torque required at a particular string depth significantly increases and this will deviate from the calculated values of surface torque of a clean casing. These actual surface torque values are represented by the line labeled "B".

The actual surface torque versus string depth is measured by a series of sensors present at the surface on the drilling rig. Such sensors are common on the drilling rig and are well-known to those skilled in the art. With this information, the operator can then determine how far the actual surface torque deviates from the calculated values of surface torque along the chart line.

Therefore, it is possible in real time at regular intervals during the drilling process to calculate values of the surface torque at particular drill string depths and compare those calculated values against the actual values. It is not necessary to create an entire T&D chart but only one particular point on that chart representing the actual condition. As a practical matter, the values could be calculated as frequently as possible. However, the inventors believe that calculating values every five seconds may be preferable and may avoid unnecessary calculations.

As the result of this monitoring, the inventors have realized that by comparing the real time values against the calculated values, it is possible to understand the drilling conditions and to make an informed decision on whether or not it is necessary to circulate the well. If it is at all possible to reduce the number of times the well is circulated, then this would increase the time of actual drilling, thereby resulting in a significant time and cost savings.

As a general guideline, when the actual surface torque exceeds the calculated value of the surface torque by a predetermined threshold amount, then at that time the well may be circulated. The determination of the threshold amount is determined entirely at the discretion of the drill operator. While the threshold percentage may be as low as 1%, the threshold percentage could be as high as 10%. A typical threshold percentage may be 5%.

Figure 5:
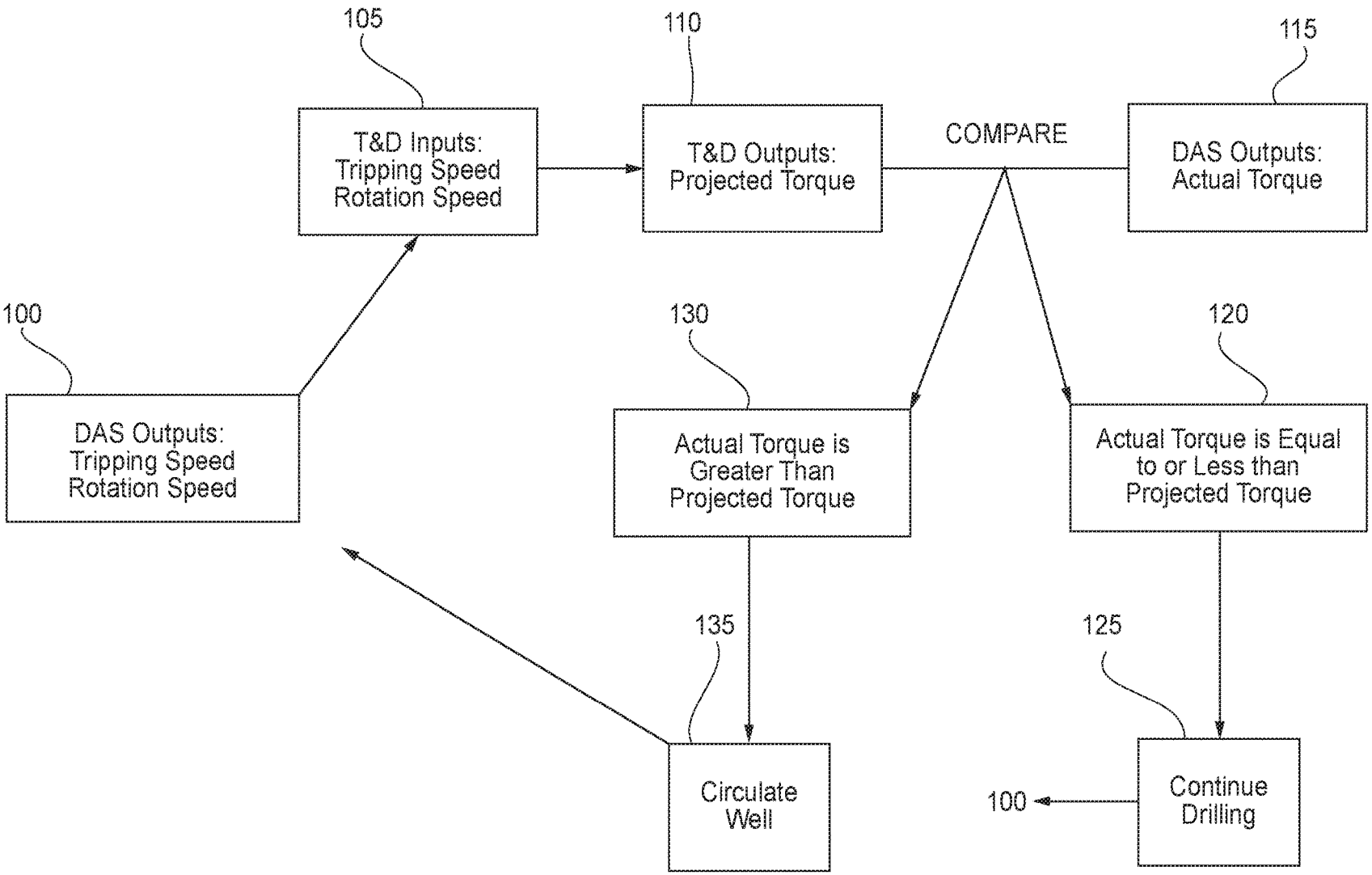
FIG. 5 is a flowchart illustrating the method by which the subject invention operates.

FIG. 5 is a flow chart of one embodiment of the process discussed herein. As illustrated by 100, the primary data available to the operator is the tripping speed and the rotation speed. Based upon predefined parameters, as shown in box 105, the operator has two primary input controls which are inputting the tripping speed and the rotation speed. With these input values, the values of torque and drag 110 may be calculated, or projected, and compared with the actual torque 115 provided by sensors on the drilling rig. If the actual value of torque is equal to or less than the calculated, or projected, value of torque 120, then the operator will continue drilling 125. Thereafter, the operator will return to drilling and continue to monitor the actual values 100. However, if the actual value of torque is greater than the calculated value of torque 130, then depending upon that difference, the operator will circulate the well 135. Thereafter, the operator will return to drilling and continue to monitor the actual values 100.

Overall, for completion of a non-conventional well, with perforated well casings in place within the wellbore and frac plugs separating segments of the well casing, a method of optimizing clean out of residual materials from the well casings to allow gas to flow from the well comprises the steps of:

A) inserting a tubular string within the actual well casing and monitoring in real time the actual tripping speed, the actual string rotation speed, and the actual surface torque imparted to the tubular string at a particular string depth;

B) for the given tubular string and for a predefined clean well casing based upon the actual well casing using mathematical modeling with a friction factor, generating a calculated value of surface torque with respect to the actual string depth at the particular string depth, the actual tripping speed, and at the actual rotation speed of the tubular string;

C) comparing the actual value of surface torque at the particular string depth to the calculated value of surface torque at that particular string depth; and D) when the actual value of surface torque exceeds the calculated value of surface torque by a predetermined amount, then circulating the well.

There are certain circumstances whereby the original friction factor selected for the drilling process may not have been accurate. As a result, when the drilling begins and the calculated values over a range of string depths do not align with the actual values, then the operator can consider adjusting the friction factor to better accommodate the actual values from the drilling operation. In particular, after the well has circulated, then the values of the actual surface torque and the actual string depth are compared to the values of the calculated surface torque at that string depth and, depending on the amount those values deviate, the friction factor may be changed. In one instance, if after circulating, the actual value of surface torque exceeds the calculated value of surface torque by a threshold value, then the friction factor may be adjusted to best accommodate the actual surface torque and at actual string depths. Just as with the threshold value used by the operator to determine whether or not to circulate the well, the threshold value to be used to determine when to adjust the friction factor is also at the discretion of the operator and may be anywhere from 1%-10%. A typical percentage could be 5%.

By doing so, the operator may closely monitor the drilling operation and decide when to circulate. Additionally, it is possible to provide an alert or an alarm to the operator whenever certain parameters are exceeded, such as the actual surface torque exceeding the calculated value of surface torque at a particular depth by a certain threshold percentage. At that point, the operator may circulate the casing.

Figure 6:
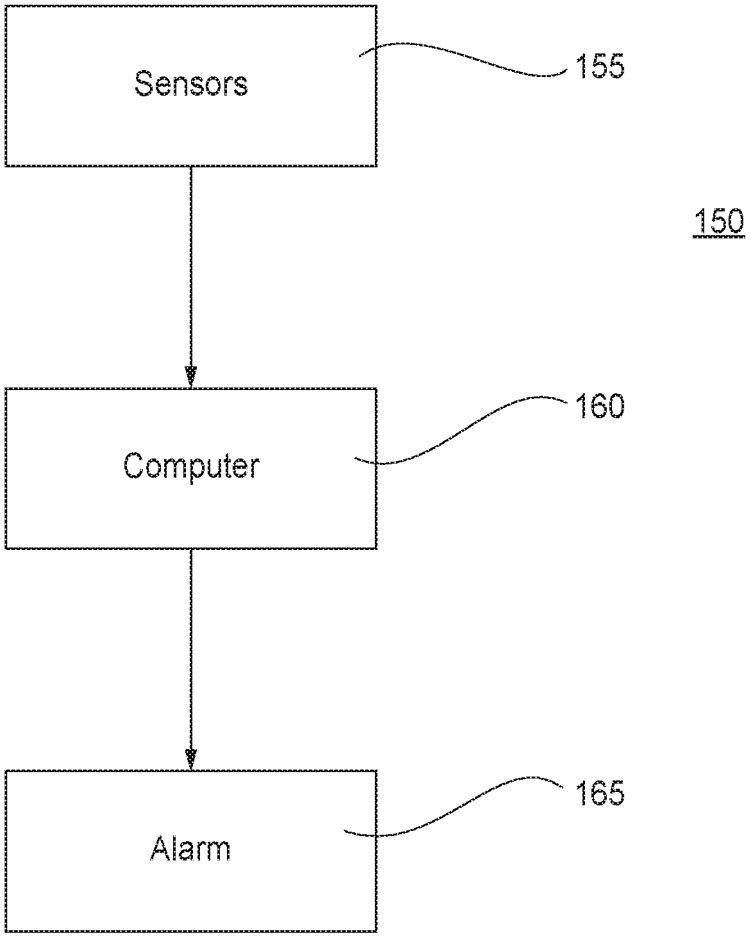
FIG. 6 is a flowchart illustrating a system in accordance with the subject invention.

FIG. 6 illustrates a system 150 for completion of a non-conventional well, with perforated well casings in place within the wellbore and frac plugs separating segments of the well casing. Sensors 155 are part of the drilling rig and provide in real time the actual tripping speed, the actual string rotation speed, and the actual surface torque imparted to the tubular string at the particular string depth. For the given tubular string and for a predefined clean well casing, a computer 210 is used with a mathematical model and a friction factor for generating a calculated value of surface torque with respect to actual string depth at the particular string depth, the actual tripping speed, and at the actual rotation speed of the tubular string. The computer 160 is used to compare the values of actual surface torque and actual string depth to the values of calculated surface torque at the actual string depth. An alert or an alarm 165 is actuated when the actual value of surface torque exceeds the calculated value of surface torque by a predetermined percentage.

While so far discussed is operator action to stop drilling and initiating the circulation process where the actual torque values exceed the calculated torque values, this switch between drilling and circulation may also be done automatically. Furthermore, to the extent that the actual torque values are continuously compared to the calculated torque values, it is also possible for the drilling operation to be automated to the degree that the desired surface torque, tripping speed, and rotation speed can be identified and the drilling process automatically adjusted to accommodate these values with less operator involvement.

Furthermore, while so far discussed is the application of this technique to the snubbing of a nonconventional well, it should be appreciate that the applications may extend well beyond this particular use. Using the mathematical model as described herein, drilling operation, such as case hole, open hole, or horizontal drilling application during completion operations may be optimized or may be monitored to identify unexpected conditions. As an example, when drilling an open hole, without the existence of a casing, by using the mathematical model and calculated values described herein, it is possible to identify when the tubular string may be overloaded or under loaded such that the operator may operate the tubular string with better efficiency or may become aware of unexpected conditions within the well.

In particular, for working a well, a method of optimizing performance of the drilling operation comprising the steps of:

A) inserting a tubular string within the well and monitoring in real time the actual tripping speed, the actual string rotation speed, and the actual surface torque imparted to the tubular string at a particular string depth;

B) for the given tubular string and for a predefined clean well using mathematical modeling with a friction factor, generating a calculated value of surface torque with respect to actual tubular depth at the particular string depth, the actual tripping speed, and at the actual rotation speed of the tubular string;

C) comparing the actual value of surface torque and string depth to the calculated value of the surface torque at the particular string depth; and D) when the actual value of surface torque exceeds the calculated value of surface torque by a predetermined amount, then adjusting the well operation.

Such an adjustment may be any number of actions including rotary speed (RPM), tripping speed, fluid weight, adding chemicals to reduce friction, or circulating to remove the friction-increasing chemicals from the well.

Figure 7:
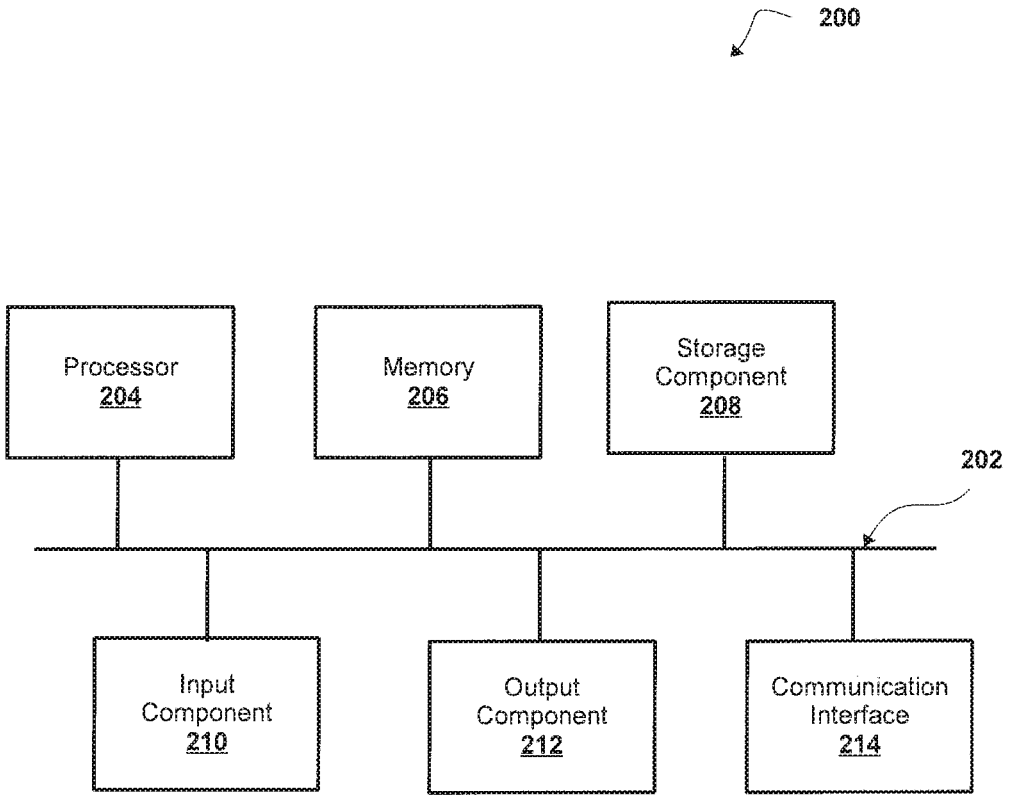
FIG. 7 is a diagram of example components of a computer, or device 200.

Referring now to FIG. 7, FIG. 7 is a diagram of example components of a device 200. Device 200 may correspond to the computer 160. As shown in FIG. 7, device 200 may include a bus 202, a processor 204, memory 206, a storage component 208, an input component 210, an output component 212, and a communication interface 214.

Bus 202 may include a component that permits communication among the components of device 200. In some non-limiting embodiments or aspects, processor 204 may be implemented in hardware, firmware, or a combination of hardware and software. For example, processor 204 may include a processor (e.g., a central processing unit (CPU), a graphics processing unit (GPU), an accelerated processing unit (APU), etc.), a microprocessor, a digital signal processor (DSP), and/or any processing component (e.g., a field-programmable gate array (FPGA), an application-specific integrated circuit (ASIC), etc.) that can be programmed to perform a function. Memory 206 may include random access memory (RAM), read only memory (ROM), and/or another type of dynamic or static storage device (e.g., flash memory, magnetic memory, optical memory, etc.) that stores information and/or instructions for use by processor 204.

Storage component 208 may store information and/or software related to the operation and use of device 200. For example, storage component 208 may include a hard disk (e.g., a magnetic disk, an optical disk, a magneto-optic disk, a solid state disk, etc.), a compact disc (CD), a digital versatile disc (DVD), a floppy disk, a cartridge, a magnetic tape, and/or another type of computer-readable medium, along with a corresponding drive.

Input component 210 may include a component that permits device 200 to receive information, such as via user input (e.g., a touch screen display, a keyboard, a keypad, a mouse, a button, a switch, a microphone, etc.). Additionally, or alternatively, input component 210 may include a sensor for sensing information (e.g., a global positioning system (GPS) component, an accelerometer, a gyroscope, an actuator, etc.). Output component 212 may include a component that provides output information from device 200 (e.g., a display, a speaker, one or more light-emitting diodes (LEDs), etc.).

Communication interface 214 may include a transceiver-like component (e.g., a transceiver, a separate receiver and transmitter, etc.) that enables device 200 to communicate with other devices, such as via a wired connection, a wireless connection, or a combination of wired and wireless connections. Communication interface 214 may permit device 200 to receive information from another device and/or provide information to another device. For example, communication interface 214 may include an Ethernet interface, an optical interface, a coaxial interface, an infrared interface, a radio frequency (RF) interface, a universal serial bus (USB) interface, a Wi-Fi® interface, a cellular network interface, and/or the like.

Device 200 may perform one or more processes described herein. Device 200 may perform these processes based on processor 204 executing software instructions stored by a computer-readable medium, such as memory 206 and/or storage component 208. A computer-readable medium (e.g., a non-transitory computer-readable medium) is defined herein as a non-transitory memory device. A memory device includes memory space located inside of a single physical storage device or memory space spread across multiple physical storage devices.

Software instructions may be read into memory 206 and/or storage component 208 from another computer-readable medium or from another device via communication interface 214. When executed, software instructions stored in memory 206 and/or storage component 208 may cause processor 204 to perform one or more processes described herein. Additionally, or alternatively, hardwired circuitry may be used in place of or in combination with software instructions to perform one or more processes described herein. Thus, embodiments or aspects described herein are not limited to any specific combination of hardware circuitry and software.

The number and arrangement of components shown in FIG. 7 are provided as an example. In some non-limiting embodiments or aspects, device 200 may include additional components, fewer components, different components, or differently arranged components than those shown in FIG. 7. Additionally, or alternatively, a set of components (e.g., one or more components) of device 200 may perform one or more functions described as being performed by another set of components of device 200.

While certain embodiments of the invention are shown in the accompanying figures and described herein above in detail, other embodiments will be apparent to and readily made by those skilled in the art without departing from the scope and spirit of the invention. For example, it is to be understood that this disclosure contemplates that to the extent possible, one or more features of any embodiment can be combined with one or more features of the other embodiment. Accordingly, the foregoing description is intended to be illustrative rather than restrictive.

The invention claimed is:

1. For completion of a non-conventional well, with perforated well casings in place within the wellbore and frac plugs separating segments of the well casing, a method of optimizing clean out of residual materials from the well casings to allow gas to flow from the well comprising the steps of:

A) inserting a tubular string within an actual well casing and monitoring in real time actual tripping speed, actual string rotation speed, and actual surface torque imparted to the tubular string at a particular string depth;

B) for the given tubular string and for a predefined clean well casing based upon the actual well casing using mathematical modeling of the predefined clean well casing and a friction factor, generating a calculated value of surface torque at the particular string depth, the actual tripping speed, and at the actual rotation speed of the tubular string;

C) comparing an actual value of surface torque at the particular string depth to the calculated value of surface torque for the predefined clean well casing and a friction factor over a range of string depths; and D) when the actual values of surface torque exceed the calculated values of surface torque for the predefined clean well casing and a friction factor over the range of string depths by a predetermined amount, then circulating the well to clean out the residual material.

2. The method according to claim 1, wherein the predetermined amount is between 1-5%.

3. The method according to claim 1, wherein the method comprising the further steps of:

E) after the well is circulated, then comparing over the range of string depths the actual values of the surface torque at a string depth to the calculated values of the surface torque over the range of string depths for the predefined clean well casing and a friction factor; and F) when the actual values of the surface torque continue to exceed the calculated values of the surface torque for the predefined clean well casing and a friction factor by a predetermined amount, then adjusting the friction factor such that the calculated torque values more closely conform with the calculated values of the surface torque for the predefined clean well casing and a friction factor over the range of string depths.

4. The method according to claim 3, wherein the predetermined amount is between 1-5%.

5. The method according to claim 1, wherein the actual value of the surface torque is measured and the calculated value of the surface torque is calculated for the predefined clean well casing and a friction factor and compared continuously during an active drilling operation.

6. The method according to claim 1, wherein circulating the well is performed manually by an operator.

7. The method according to claim 1, wherein circulating the well is done automatically by switching over from drilling to circulate without manual intervention.

8. The method according to claim 1, wherein prior to the step of circulating the well, sending an alert to a drilling rig operator when the actual value of the surface torque exceeds the calculated value of surface torque for the predefined well casing 4114 and a friction factor by a predetermined amount.

9. The method according to claim 8, wherein the predetermined amount is between 1-5%.

10. For completion of a non-conventional well, with perforated well casings in place within the wellbore and frac plugs separating segments of the well casing, a method of optimizing clean out of residual materials from the well casings to allow gas to flow from the well comprising the steps of:

A) inserting a tubular string within the well casing and monitoring in real time actual tripping speed, actual string rotation speed, and actual surface torque imparted to the tubular string at a particular string depth;

B) for the given tubular string and for a predefined clean well casing based upon the actual well casing using mathematical modeling of the predefined clean well casing and a friction factor, generating a calculated value of surface torque at the particular string depth, the actual tripping speed, and at the actual rotation speed of the tubular string;

C) comparing an actual value of surface torque at the particular string depth to the calculated value of surface torque for the predefined clean well casing and a friction factor over a range of string depths; and D) when the actual values of the surface torque exceed the calculated values of the surface torque for the predefined clean well casing and a friction factor over the range of string depths by a predetermined amount, then sending an alert to inform a drilling rig operator that circulating the well may be needed.

11. The method according to claim 10, wherein the predetermined amount is between 1-5%.

12. A system for completion of a non-conventional well, with perforated well casings in place within the wellbore and frac plugs separating segments of the well casing, comprising:

A) sensors mounted upon a drill rig to provide in real time actual tripping speed, actual string rotation speed, and actual surface torque imparted to the tubular string at a particular string depth;

B) for the given tubular string and for a predefined clean well casing based upon characteristics of the actual well casing, a computer configured to use mathematical modeling for the predefined clean well casing and a friction factor for generating a calculated value of surface torque for the predefined clean well casing and a friction factor at the particular string depth, at the actual tripping speed, and at the actual rotation speed of the tubular string;

C) wherein the computer configured to compare actual values of surface torque at the actual string depth to the calculated value of surface torque for the predefined clean well casing and a friction factor over a range of string depths; and D) wherein the computer is also configured to generate an alert or an alarm that is actuated when the actual values of surface torque exceeds the calculated values of surface torque for the predefined clean well casing and a friction factor over the range of string depths by a predetermined percentage.

13. The system according to claim 12, wherein the predetermined percentage is between 1-5%.

14. For working a well, a method of optimizing performance of the drilling operation comprising the steps of:

A) inserting a tubular string within the well and monitoring in real time actual tripping speed, actual string rotation speed, and actual surface torque imparted to the tubular string at a particular string depth;

B) for the given tubular string and for a predefined clean well using mathematical modeling of the predefined clean well and a friction factor, generating a calculated value of surface torque with respect to actual tubular depth at the particular string depth, the actual tripping speed, and at the actual rotation speed of the tubular string;

C) comparing an actual value of surface torque and string depth to the calculated value of the surface torque for the predefined clean well casing and a friction factor over a range of string depths; and D) when the actual values of surface torque exceeds the calculated values of surface torque for the predefined clean well casing and a friction factor over the range of string depths by a predetermined amount, then adjusting the well operation.

15. The method according to claim 14, wherein the predetermined amount is between 1-5%.

16. The method according to claim 14, wherein the predetermined amount is 5%.

17. The method according to claim 14, wherein comprising the further steps of:

E) after the well is circulated, then comparing over the range of string depths the actual values of the surface torque at a string depth to the calculated values of the surface torque for the predefined clean well casing and a friction factor over the range of string depths; and F) when the actual values of the surface torque continue to exceed the calculated values of the surface torque for a predefined well casing and a friction factor by a predetermined amount, then adjusting the friction factor such that the calculated torque values more closely conform with the calculated values of the surface torque for the predefined clean well casing and a friction factor over the range of string depths.

18. The method according to claim 17, wherein the predetermined amount is between 1-5%.

19. The method according to claim 14, wherein the actual value of the surface torque is measured and the calculated value of the surface torque for the predefined clean well casing and a friction factor is calculated continuously during an active drilling operation.

20. The method according to claim 14, wherein circulating the well is performed manually by an operator.

* * * * *